US006170100B1

(12) United States Patent
Le Gette et al.

(10) Patent No.: US 6,170,100 B1
(45) Date of Patent: Jan. 9, 2001

(54) SELF-OPENING TOWEL

(75) Inventors: Brian Edward Le Gette, Severna Park, MD (US); James Ashley Waring, Vernon Hill, IL (US)

(73) Assignee: Gray Matter Holdings, LLC, Baltimore, MD (US)

( * ) Notice: Under 35 U.S.C. 154(b), the term of this patent shall be extended for 0 days.

(21) Appl. No.: 09/081,134

(22) Filed: May 19, 1998

(51) Int. Cl.[7] ..... A47G 9/06

(52) U.S. Cl. ..... 5/417; 5/653; 5/420; 5/657; 297/229; 297/219.1

(58) Field of Search ..... 5/417, 419, 420, 5/653, 656, 657; 160/37.21; 297/229, 219.1, 352, 230.11, 452.13, 452, 19, 452.2

(56) References Cited

U.S. PATENT DOCUMENTS

| | | | | |
|---|---|---|---|---|
| Re. 35,571 | | 7/1997 | McLeese | 135/126 |
| D. 349,593 | | 8/1994 | Hensley | D34/1 |
| 722,801 | | 3/1903 | Bourne . | |
| 1,479,903 | | 1/1924 | Erland . | |
| 2,119,023 | * | 5/1938 | Pickard | 297/452.13 |
| 2,344,010 | | 3/1944 | Walsh | 2/69 |
| 2,442,105 | | 5/1948 | Vacheron | 2/69.5 |
| 2,731,997 | | 1/1956 | Muth et al. | 150/11 |
| 2,803,291 | * | 8/1957 | Meyer | 297/452.13 |
| 2,870,464 | | 1/1959 | Lalick | 5/334 |
| 3,052,895 | | 9/1962 | Lo Vico | 5/344 |
| 3,862,876 | | 1/1975 | Graves | 161/44 |
| 4,296,788 | | 10/1981 | Slater | 150/52 |
| 4,561,480 | | 12/1985 | Underwood et al. | 150/49 |
| 4,709,430 | | 12/1987 | Nicoll | 5/417 |
| 4,815,784 | | 3/1989 | Zheng | 296/97.7 |
| 4,825,892 | | 5/1989 | Norman | 135/104 |
| 4,951,333 | | 8/1990 | Kaiser et al. | 5/417 |
| 5,038,812 | | 8/1991 | Norman | 135/104 |
| 5,056,172 | * | 10/1991 | Kaiser et al. | 5/417 |
| 5,059,463 | | 10/1991 | Peters | 428/65 |
| 5,116,273 | | 5/1992 | Chan | 160/370.2 |
| 5,163,461 | | 11/1992 | Ivanovich et al. | 135/104 |
| 5,206,964 | * | 5/1993 | Wilson, Sr. | 5/417 |
| 5,213,147 | | 5/1993 | Zheng | 160/370.2 |
| 5,261,131 | * | 11/1993 | Kilby | 5/417 |
| 5,299,331 | * | 4/1994 | Badillo | 5/417 |
| 5,396,917 | | 3/1995 | Hazinski et al. | 135/104 |
| 5,435,025 | | 7/1995 | Gerard et al. | 5/419 |
| 5,454,643 | | 10/1995 | Sullivan | 383/4 |
| 5,533,653 | | 7/1996 | Kaufman | 224/577 |
| 5,618,110 | | 4/1997 | Sullivan | 383/4 |
| 5,629,071 | | 5/1997 | Feldman | 428/192 |
| 5,688,052 | | 11/1997 | Compton | 383/38 |
| 5,693,398 | | 12/1997 | Granger | 428/66.7 |
| 5,729,846 | | 3/1998 | Sullivan | 5/419 |
| 5,730,529 | | 3/1998 | Fritz et al. | 383/4 |
| 6,073,283 | * | 6/2000 | Zheng | 5/417 |

* cited by examiner

*Primary Examiner*—Michael F. Trettel
(74) *Attorney, Agent, or Firm*—Kenyon & Kenyon

(57) ABSTRACT

A self-opening towel comprises a frame member being formed from a flexible twistable material and being removably attached to a covering membrane. The self-opening towel has a first shape being substantially planar when in an extended configuration, and a second shape being substantially planar and having an area less than an area of the first shape when the towel is in a collapsed configuration.

17 Claims, 7 Drawing Sheets

SELF-OPENING TOWEL

BACKGROUND OF THE INVENTION

The present invention generally relates to a towel having multiple configurations. More specifically, the present invention relates to a towel that self-opens into an extended configuration, and also can be in a collapsed position and a chair configuration.

Conventional beach towels are typically used to dry a person, to separate a person from, for example, beach sand, and/or to line a chair. Difficulty exists, however, in maintaining the shape of conventional beach towels when being used, for example, to separate a person from beach sand or to line a chair.

Several attempts have been tried to remedy these problems with towels. For example, U.S. Pat. No. 3,862,876, issued to Graves, discloses one attempt to maintain the desired shape of a towel. The towel in Graves has continuous flexible weights secured along at two opposed edges of the towel. U.S. Pat. No. 4,709,430, issued to Nicoll, discloses a beach blanket having a non-metallic tube filled with a liquid weight such as water located at the perimeter of the blanket.

These known towels, however, can be difficult to arrange when configured to have a large size. These towels can be cumbersome to arrange for separating a person from the beach sand, to line a chair, and to pack for removal.

SUMMARY OF THE INVENTION

A self-opening towel comprises a frame member being formed from a flexible twistable material and being removably attached to a covering membrane. The self-opening towel has a first shape being substantially planar when in an extended configuration, and a second shape being substantially planar and having an area less than an area of the first shape when the towel is in a collapsed configuration.

In one embodiment, the covering membrane has an upper side, a lower side and an interior portion between the upper side and the lower side. The frame member can be removably inserted within the interior portion of the covering membrane. The self-opening towel can also include a fastener having a first portion and a second portion. The first portion of the fastener can be attached to the upper side of a covering membrane; the second portion of the fastener can be attached to the lower side of the covering membrane. The fastener, when in an open position, can have a width between an upper side and a lower side of the covering membrane sufficient for the frame member to be slidably inserted into and slidably removed from an interior portion of the covering membrane.

DETAILED DESCRIPTION

Figure 1:
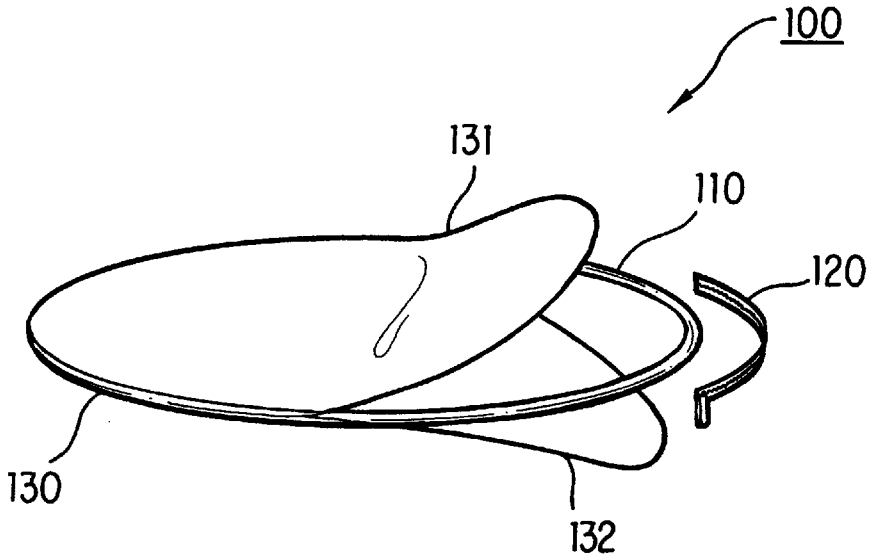
FIG. 1 illustrates a self-opening towel according to an embodiment of the present invention.

FIG. 1 illustrates a self-opening towel, according to an embodiment of the present invention. Self-opening towel 100 includes frame member 110, fastener 120 and covering membrane 130 which includes upper side 131 and lower side 132. Covering membrane 130 can be made of various types of appropriate materials. For example, the upper side 131 of covering membrane 130 can be made of terry cloth and can absorb moisture; the lower side 132 of covering membrane 130 can be made of nylon and can block moisture.

In this embodiment, the upper side 131 and lower side 132 of covering membrane 130 are connected along the perimeter except for the portion of the perimeter where fastener 120 is connected along the seam of the perimeter. For example, the upper side 131 and lower side 132 of covering membrane 130 are connected by a sewn seam along the perimeter of covering membrane 130. Covering membrane 130 can have dimensions of, for example, approximately 5'6"×3'6".

Fastener 120 can include a first portion which is attached to the upper side 131 of covering membrane 130 and a second portion which is attached to lower side 132 of covering membrane 130. Fastener 120 can be, for example, a zipper or a set of snaps. Where fastener 120 is a zipper, the two portions of the zipper can be sewn to the respective side of covering membrane 130.

Figure 2:
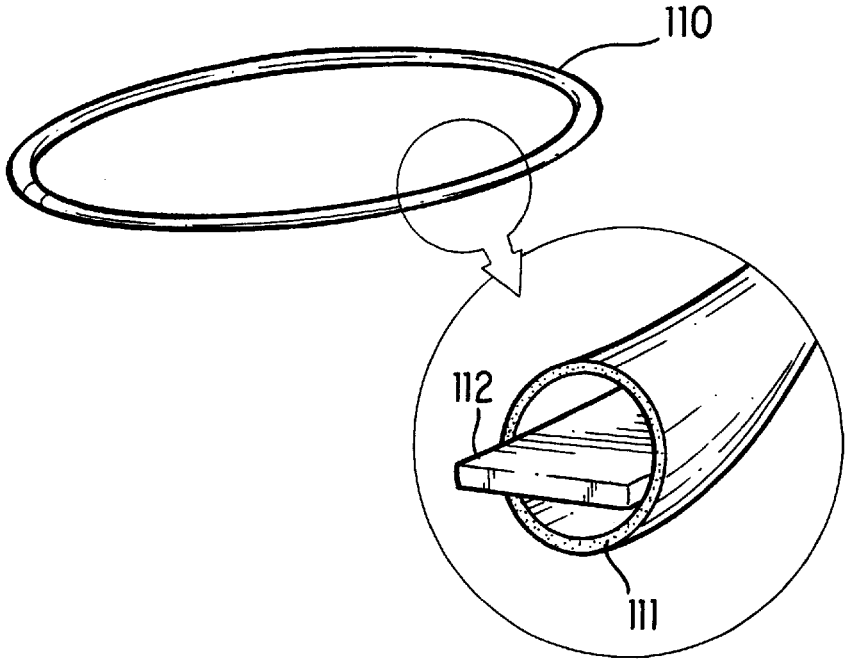
FIG. 2 illustrates a frame member of a self-opening towel, according to an embodiment of the present invention.

FIG. 2 illustrates a frame member of a self-opening towel, according to an embodiment of the present invention. In this embodiment, frame member 110 includes tube 111 and closed, spring-like loop 112. Closed, spring-like loop 112 can be made up of, for example, metal or any similar type of material. Closed, spring-like loop 112 can have dimensions appropriate to maintain the shape of self-opening towel 100 when in an extended configuration, yet flexible and twistable enough to allow the transition to or from an extended configuration, a collapsed configuration and/or a chair configuration. For example, closed, spring-like loop 112 can have the dimensions of ¼" by 1/16".

Tube 111 can be made of any sort of appropriate material such as rubber which is flexible yet sturdy enough to maintain closed, spring-like loop 112 being encased within the interior portion of tube 111. Tube 111 can be constructed of a waterproof material like rubber or plastic which can prevent water from contacting and rusting closed, spring-like loop 112.

FIGS. 3–8 show a process, in ascending order, according to an embodiment of the present invention, by which a self-opening towel can be transformed from an extended configuration to a collapsed configuration. Of course, the process can be reversed to illustrate the process of transforming self-opening towel 100 from a collapsed configuration to an extended configuration by following FIGS. 3–8 in descending order.

Figure 3:
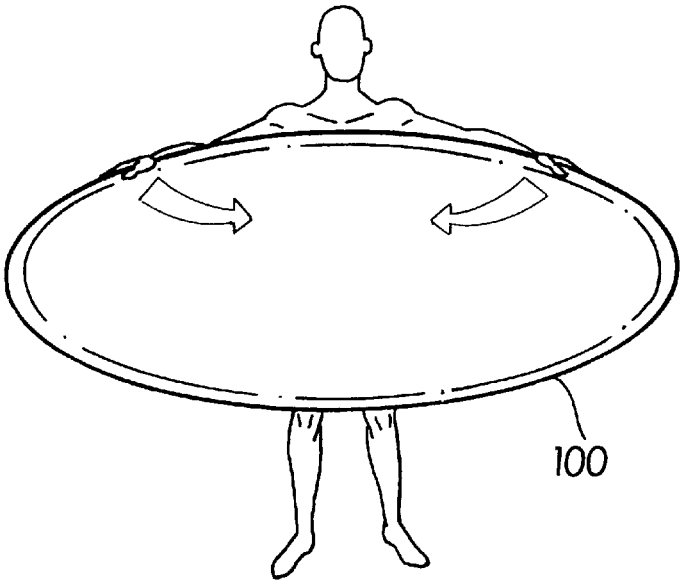
FIGS. 3–8 show a process, according to an embodiment of the present invention, by which a self-opening towel can be transformed from an extended configuration to a collapsed configuration.
Figure 4:
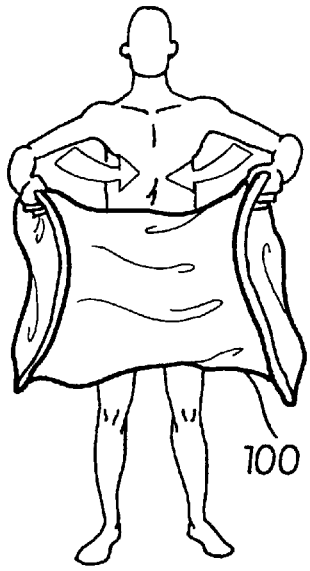
Figure 5:
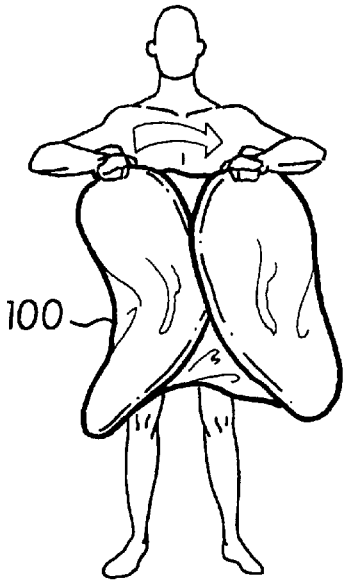
Figure 6:
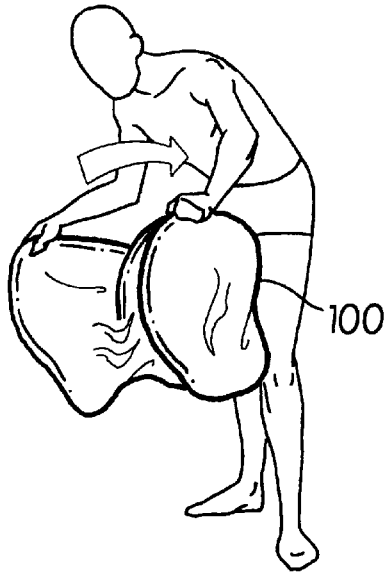
Figure 7:
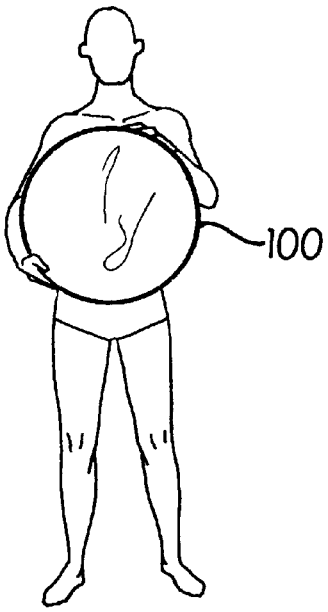

As shown in FIG. 3, where the longer side of self-opening towel 100 lies across from 3 o'clock to 9 o'clock, a person can hold the edge of self-opening towel 100 at approximately 2 o'clock and 10 o'clock. As shown in FIG. 4, the ends of towel 100 along the longer side can then be folded towards the center, away from the person. As shown in FIG. 5, one end of the towel 100 can be further brought towards the center. As shown in FIG. 6, the remaining end of towel 100 can then be folded over so that towel 100 is folded into a substantially circular shape approximately one-third the area of the towel when in a extended configuration as shown in FIG. 3.

Figure 8:
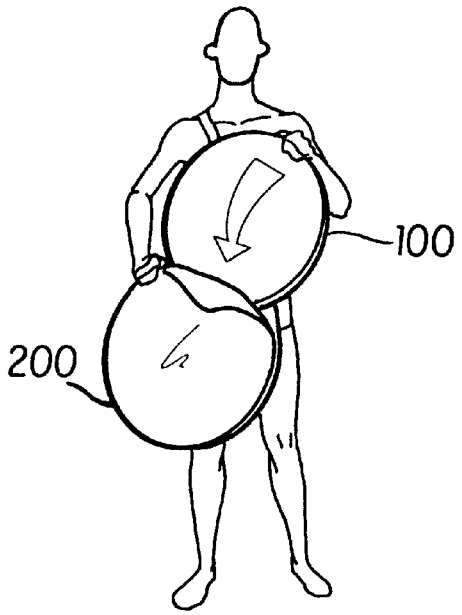

Please note that self-opening towel 100 in a collapsed configuration is approximately or substantially planar in shape although it does have a thickness approximately greater than the thickness of the towel as shown in an extended configuration. The term "substantially planar" merely indicates that the towel is approximately flat although not exactly lying within a plane in a purely geometric sense. As shown in FIG. 8, self-opening towel 100 in a collapsed configuration can be placed into carrying case 200 for storage and/or transport.

Figure 9:
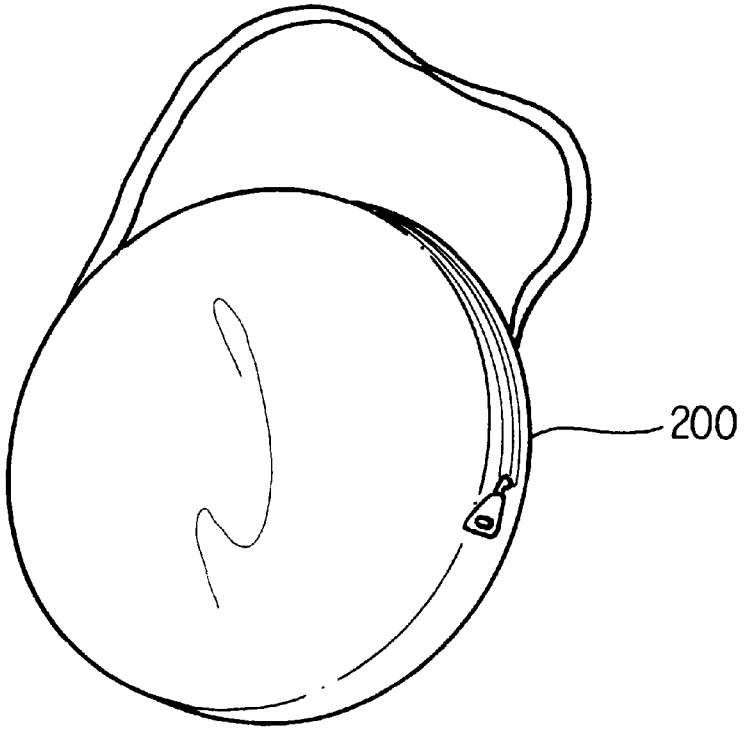
FIG. 9 illustrates the carrying case into which a self-opening towel can be placed for storage and/or transport, according to an embodiment of the present invention.

FIG. 9 illustrates the carrying case into which a self-opening towel can be placed for storage and/or transport, according to an embodiment of the present invention. As shown in FIG. 9, carrying case 200 includes a strap, a zipper which can provide an opening to the interior portion of carrying case 200. Carrying case 200 can be made of, for example, the same materials as self-opening towel 100. Additionally, the strap can be attached to the main body of carrying case 200, for example, by attaching one end of the strap to one side of the main body and attaching the other end of the strap to the other side of the main body.

FIGS. 10–14 illustrate a process, according to an embodiment of the present invention, by which the self-opening towel can be transformed from an extended configuration to a chair configuration. Of course, the self-opening towel 100 can be changed from a chair configuration to the extended configuration by following FIGS. 10 through 14 in descending order.

Figure 10:
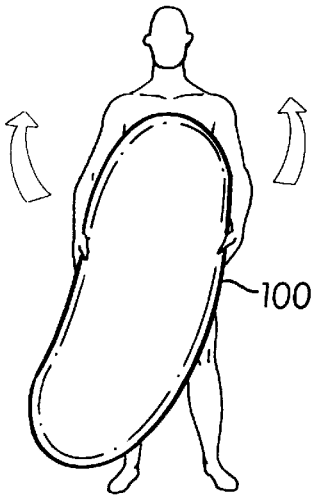
FIGS. 10–14 illustrate a process, according to an embodiment of the present invention, by which the self-opening towel can be transformed from an extended configuration to a chair configuration.
Figure 11:
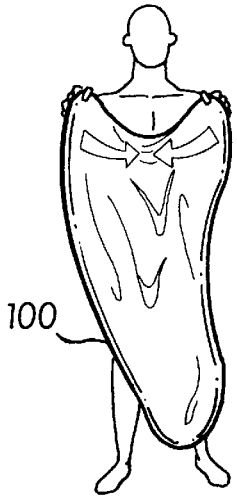
Figure 12:
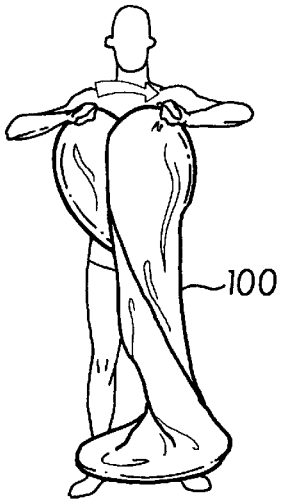
Figure 13:
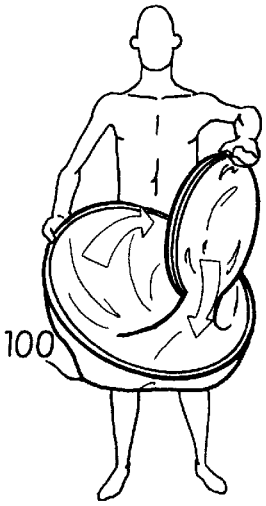
Figure 14:
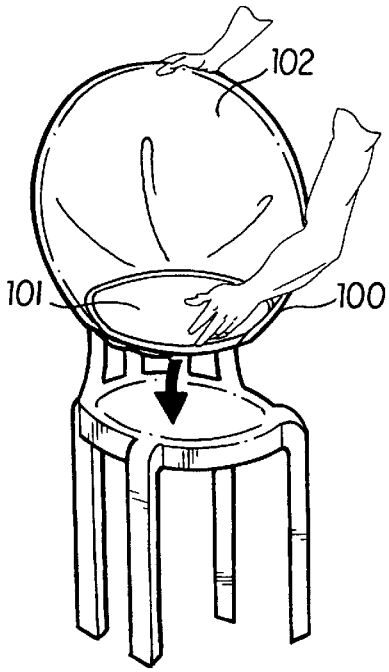

As shown in FIG. 10, where the longer side of self-opening towel 100 lies across from 12 o'clock to 6 o'clock, a person can hold the edge of self-opening towel 100 at approximately 2 o'clock and 10 o'clock. As FIG. 11 shows, the person can then bring the two sides of the towel upward and rotating the sides inward. As FIG. 12 shows, the person can then bring the two sides parallel along each other. Then as FIG. 13 shows, the top of the two sides can then be brought rotated down towards the crease that is made with the top half of the towel. Self-opening towel 100 now has seat portion 101 and back portion 102 as illustrated in FIG. 14.

Figure 15:
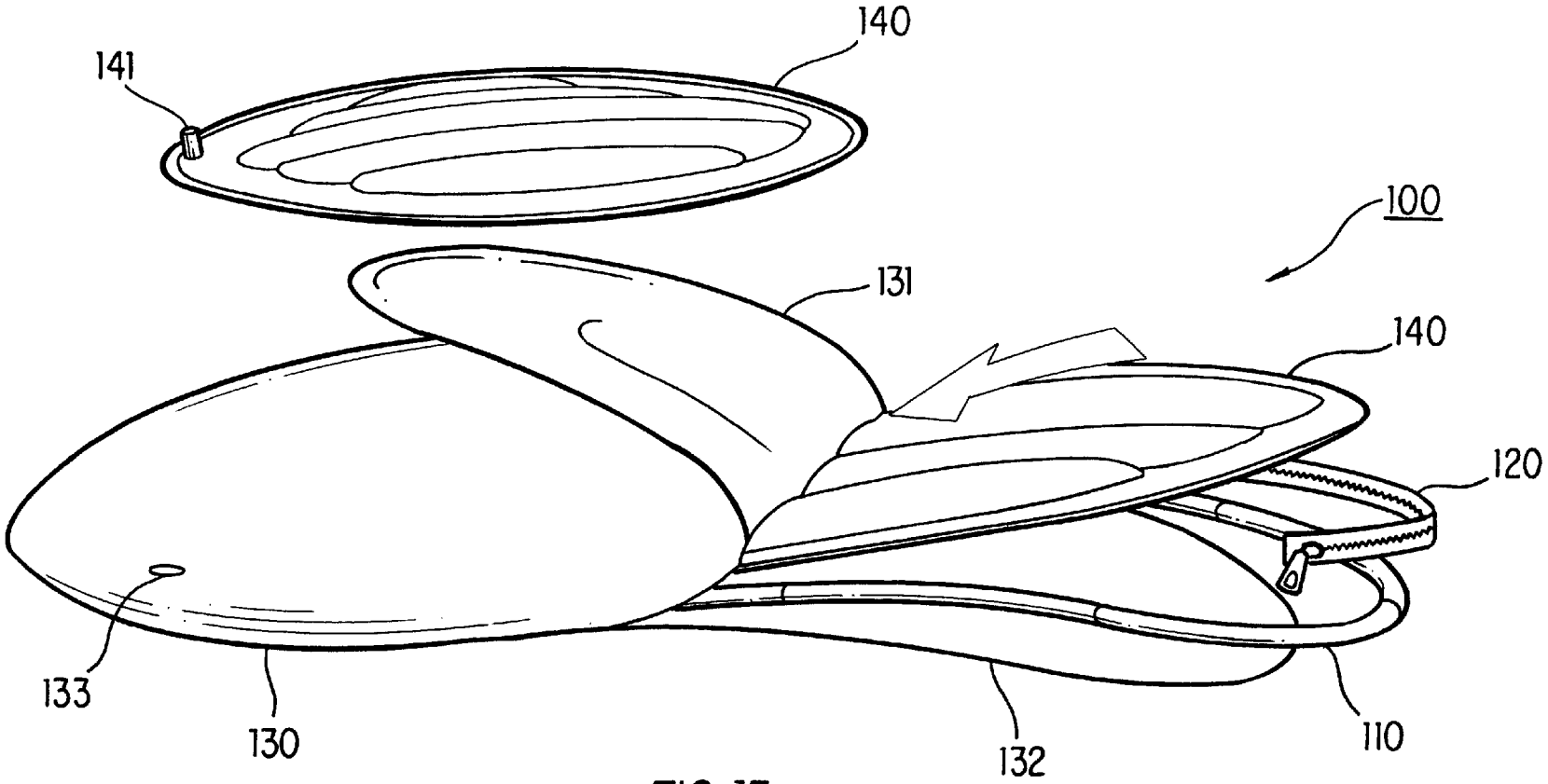
FIG. 15 illustrates an air-inflatable mat, according to an embodiment of the present invention, which can be inserted into an interior portion of a covering membrane.

Additional items can be also used in conjunction with a self-opening towel, for example, by inserting an additional item into the interior portion of a self-opening towel. FIG. 15 illustrates an air-inflatable mat, according to an embodiment of the present invention, which can be inserted into an interior portion of a covering membrane. More specifically, air-inflatable mat 140 can be inflated through a plug 141. Air-inflatable mat 140 can be inserted between upper side 131 and lower side 132 of covering membrane 130. Plug 141 can then be inserted through a hole 133 in upper side 131 of covering membrane 130. The air-inflatable mat 140 can be inserted into self-opening towel 100 when in an extended configuration and then removed when self-opening towel 100 is converted to a collapsed configuration or a chair configuration. Alternatively, air-inflatable mat 140 can be inserted into and retained within self-opening towel 100 when in an extended configuration, a collapsed configuration and/or a chair configuration. Air-inflatable mat 140 can be temporary inserted into self-opening towel 100 by, for example, a hook-and-pile type of fastener, or permanently inserted into self-opening towel 100 by, for example, sewing air-inflatable mat 140 into covering membrane 130 of self-opening towel 100.

Figure 16:
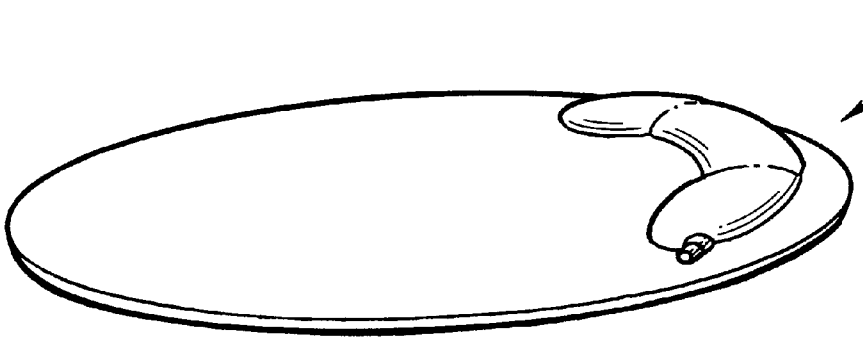
FIGS. 16 and 17 illustrate an air-inflatable cushion, according to an embodiment of the present invention, which can be inserted into an interior portion of a covering membrane.
Figure 17:
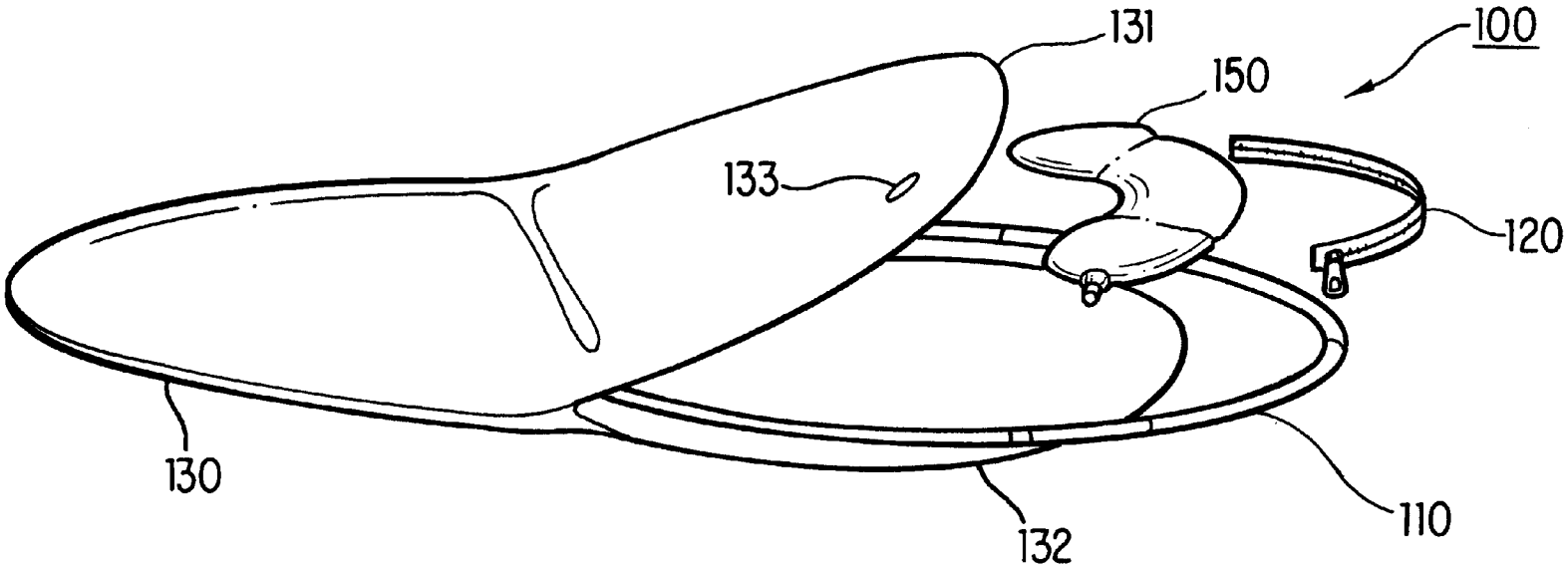

FIGS. 16 and 17 illustrate an air-inflatable cushion, according to an embodiment of the present invention, which can be inserted into an interior portion of a covering membrane. FIG. 16 shows an air-inflatable cushion inserted into self-opening towel 100; FIG. 17 shows the disassembled pieces of self-opening towel 100. As shown in FIG. 17, air-inflatable cushion 150 can be inserted between the upper side 131 and the lower side 132 of covering membrane 130. Upper side 131 of covering membrane 130 can include a hole 133 through which the plug on the air-inflatable cushion 150 can be inserted to provide access for inflating and deflating air-inflatable cushion 150. Of course, the air-inflatable cushion 150 can be inserted and removed through fastener 120 when the upper side 131 and lower side 132 of covering membrane 130 are assembled along the seam and assembled with the portions of fastener 120.

Figure 18:
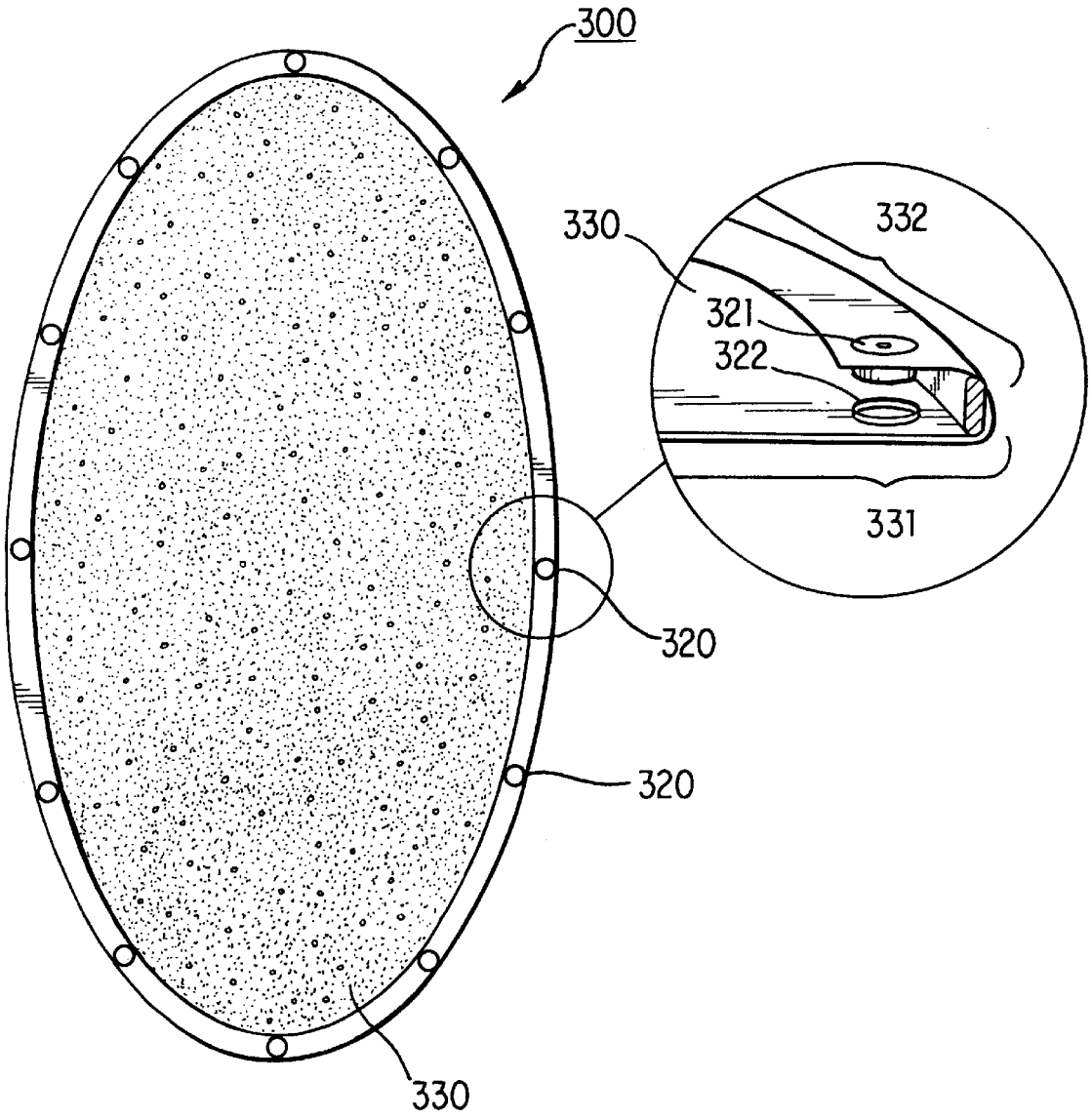
FIG. 18 illustrates a self-opening towel, according to another embodiment of the present invention.

FIG. 18 illustrates a self-opening towel, according to another embodiment of the present invention. Self-opening towel 300 includes covering membrane 330 having a central portion 331 and an extended portion 332. Extended portion 332 is folded over and attached to central portion 331 of covering membrane 330 with fasteners 320 around the perimeter of covering membrane 330.

As the blowout illustration in FIG. 18 shows, frame member 310 is a flexible twistable material which runs along the outer crease of covering membrane 330 approximately where central portion 331 and extended portion 332 of covering membrane 330 met. Frame member 310 is secured into place by a first portion 321 of fastener 320 and a second portion 322 of fastener 320. In this configuration, fasteners 320 can be unfastened. In other words, portion 321 can be disconnected from portion 322 so that frame member 310 can be removed from covering membrane 330. This allows covering membrane 330 to be, for example, washed without having frame member 310 being present. Of course, once covering membrane 330 is clean and dry, the frame member 310 can be reinserted and resecured by, again, connecting portion 321 to portion 322 of all the fasteners 320 located around the perimeter of covering membrane 330.

It should, of course, be understood that while the present invention has been described in reference to particular configurations, other configurations should be apparent to those of ordinary skill in the art. For example, although the shape of the self-opening towel is shown as being substantially oval, other shapes are possible such as shapes more circular or more rectangular.

What is claimed is:

1. A self-opening towel, comprising:

a frame member being formed from a flexible twistable material, a covering membrane, said frame member being removably attached to said covering membrane, said frame member defining a seat portion and a back portion, the seat portion being substantially planar, the back portion arcuately extending from the seat portion the seat portion has a substantially circular perimeter, the back portion has a substantially circular perimeter, is connected to a front section of the seat portion and has a depth defined by a rear section of the seat portion.

2. The self-opening towel of claim 1, wherein said frame member further includes:

a closed, flexible, springable loop; and a tube having an interior portion, said closed loop being enclosed within the interior portion of said tube, said closed, flexible, springable loop and said enclosed tube being located along a perimeter of said covering material when attached.

3. The self-opening towel of claim 1, further comprising:

a fastener having a first portion and a second portion, the first portion of said fastener being attached to an upper side of said covering membrane and the second portion of said fastener being attached to a lower side of said covering membrane, said fastener, when in an open position, having a width between the upper side and the lower side of said covering membrane sufficient for said frame member to be slidably inserted into and slidably removed from an interior portion of said covering membrane.

4. The self-opening towel of claim 1, wherein:

said covering membrane has an upper side, a lower side and an interior portion between the upper side and the lower side, said frame member being removably inserted within the interior portion of said covering membrane, the upper side of said covering membrane is terry cloth, and the lower side of said covering is nylon.

5. The self-opening towel of claim 1, further comprising:

a carrying case having an interior portion and an opening into which said covering membrane and said frame member, when in the collapsed configuration, is slidably insertable.

6. The self-opening towel of claim 1, further comprising:

an inflatable mat removably inserted into an interior portion of said covering membrane between an upper side and a lower side of said covering membrane, said frame member being removably inserted within the interior portion of said covering membrane.

7. The self-opening towel of claim 1, further comprising:

an inflatable cushion removably inserted into an interior portion of said covering membrane between an upper side and a lower side of said covering membrane, said frame member being removably inserted within the interior portion of said covering membrane.

8. A self-opening towel, comprising:

a frame member having:

a closed, flexible, springable loop, and a tube having an interior portion, said closed loop being enclosed within the interior portion of said tube;

a covering membrane having an upper side, a lower side and an interior portion between the upper side and the lower side;

said frame member being slidably inserted into and slidably removed from the interior portion of said covering membrane; and an inflatable cushion inserted into the interior portion of said covering membrane between the upper side and the lower side of said covering membrane.

9. The self-opening towel of claim 8, wherein the upper side of said covering membrane is terry cloth, and the lower side of said covering is nylon.

10. The self-opening towel of claim 8, further comprising:

a carrying case having an interior portion and an opening into which said covering membrane and said frame member, when in the collapsed configuration, is slidably insertable.

11. A self-opening towel, comprising:

a frame member having:

a closed, flexible springable loop, and a tube having an interior portion, said closed loop being enclosed within the interior portion of said tube;

a covering membrane having an upper side, a lower side and an interior portion between the upper side and the lower side;

said frame member being slidably insertable into and slidably removable from the interior portion of said covering membrane; and an inflatable mat insertable into the interior portion of said covering membrane between the upper side and the lower side of said covering membrane.

12. A self-opening towel, comprising:

a frame member having:

a closed, flexible, springable loop, and a tube having an interior portion, said closed loop being enclosed within the interior portion of said tube;

a covering membrane having an upper side, a lower side and an interior portion between the upper side and the lower side;

said frame member being slidably insertable into and slidably removable from the interior portion of said covering membrane; and an inflatable cushion insertable into the interior portion of said covering membrane between the upper side and the lower side of said covering membrane.

13. A method for folding a frame member of a towel into a chair configuration, comprising:

bringing two opposite sides of the towel upward while rotating the two sides inward;

bringing the two sides parallel along each other; and rotating the two sides down towards a crease formed within a top half of the towel.

14. The method of claim 13, wherein the towel has a long dimension and a short dimension, the two opposite sides being along the long dimension of the towel.

15. An apparatus, comprising:

a frame member being formed from a flexible twistable material, said frame member being a continuous loop;

a covering membrane, said frame member being removably coupled to said covering membrane, said frame member and said covering membrane collectively defining a first portion and a second portion, said first portion being substantially planar, said second portion extending arcuately upward from said first portion, a portion of said frame member defining said first portion is substantially circular and said covering membrane of said first portion is substantially flat, a portion of the frame member defining said second portion is substantially circular and said covering membrane of said second portion is substantially concave.

16. The apparatus of claim 15, wherein said first portion is a substantially planar seat portion of a chair and said second portion is a back portion of a chair.

17. The apparatus of claim 15, wherein the depth of said covering membrane of said second portion is defined by a rear section of said first portion.

* * * * *